US005320344A

United States Patent [19]

Henderson

[11] Patent Number: 5,320,344

[45] Date of Patent: Jun. 14, 1994

[54] TENNIS NET WITH SINGLES STICKS

[76] Inventor: John D. Henderson, 4 Muirfield, Dove Canyon, Calif. 92679

[21] Appl. No.: 870,604

[22] Filed: Apr. 16, 1992

[51] Int. Cl.[5] ..... A63B 61/00

[52] U.S. Cl. ..... 273/29 B

[58] Field of Search ..... 273/29 R, 29 A, 29 B, 273/30, 411, 29 BA, 29 BB, 29 BC, 29 BD, 29 BE, 29 BF, 29 BG

[56] References Cited

U.S. PATENT DOCUMENTS

| | | | |
|---|---|---|---|
| 1,322,754 | 11/1919 | Blair | 273/29 B |
| 1,409,981 | 3/1922 | Vaile | 273/29 BA |
| 3,549,146 | 12/1970 | Davis | 273/29 B |
| 3,649,011 | 3/1972 | Barnes | 273/29 B |
| 4,247,099 | 1/1981 | Pandak | 273/29 BA |
| 4,291,875 | 9/1981 | Smith, Jr. | 273/29 B |
| 4,440,393 | 4/1984 | Smith, Jr. | 273/29 B |
| 4,976,432 | 12/1990 | Cheney | 273/29 B |
| 5,052,686 | 10/1991 | Pryor | 273/29 B |

FOREIGN PATENT DOCUMENTS

| | | | |
|---|---|---|---|
| 2537879 | 6/1984 | Fed. Rep. of Germany | 273/29 B |
| 3843266 | 6/1990 | Fed. Rep. of Germany | 273/29 B |
| 2645450 | 10/1990 | Fed. Rep. of Germany | 273/29 B |

*Primary Examiner*—Theatrice Brown

*Attorney, Agent, or Firm*—Knobbe, Martens, Olson & Bear

[57] ABSTRACT

A tennis net for installation on a tennis court which defines both singles and doubles fields of play comprises a pair of singles sticks used to adapted the tennis net for singles and doubles play. The singles sticks engage a pair of cap to prop the tennis net to a net post height as specified by the rules of tennis set forth by the United States Tennis Association. The tennis net additionally comprises a chevron shaped bottom edge which presents a straight bottom edge juxtaposing the court when the tennis net is installed according to the rules of tennis.

19 Claims, 6 Drawing Sheets

TENNIS NET WITH SINGLES STICKS

BACKGROUND OF THE INVENTION

1. Field of the Invention

The present invention relates to a game net and, in particular, to a tennis net.

2. Description of Related Art

The rules of tennis established by the United States Tennis Association (USTA) and other worldwide governing bodies require that a tennis net have a height of 42 inches (1.07 meters) measured upwardly from the ground at the net posts of a tennis court, and have a height of 36 inches (0.91 meter) measured upwardly from the ground at the center of the tennis court. In order to meet these regulations, a conventional 42-inch (1.07-meter) high net is stretched between two net posts. A cable, which typically passes through a headband of the tennis net, suspends the net between the net posts. A center strap is then placed over the center of the net and is fastened to the ground to pull the center of the net down to a height of 36 inches (0.91 meter).

With the center strap pulling down the tennis net center, the center portion of the tennis net gathers and bunches up on the ground. The tennis net thus presents a "sloppy" appearance which detracts from the orderliness of the court. In addition, the clump of netting, which is in the direct sight of the tennis player, interferes with the player's ability to see the opponent's side of the court and tends to diminish the player's distance perception. Moreover, tennis balls commonly get caught in the folds of the net, slowing the game and causing the tennis player to fish the tennis balls out of the folds of the tennis net; a task many players consider a nuisance.

Most tennis courts define both a singles field of play and a larger doubles field of play. That is, most tennis courts define a singles court having a rectangular shape defined between a pair of parallel baselines and a pair of parallel singles sidelines. The court additionally includes a pair of doubles alleys positioned opposite from one another on opposite sides of the singles court. The alleys are 4.5 feet (1.37 meters) wide. The pair of net posts are positioned 3.0 feet (0.91 meter) outside of the sidelines of the alleys.

The tennis net commonly is installed for doubles play. The net has a height of 42 inches (1.07 meters) adjacent to the net posts and has a height of 36 inches at the center of the court. To adapt the net for singles play, a pair of singles sticks are positioned 3.0 feet (0.91 meter) outside of the sidelines of the singles court and are used to support the net headband at that location. Thus, the tennis net has a height of 42 inches (1.37 meters) at the singles sticks and has a height of 36 inches (0.91 meter) at the center of the court.

The prior singles sticks and conventional tennis net designs, however, suffer from a number of drawbacks. For instance, prior singles sticks bunch and twist the headband of the net when installed. This typically rips or frays the net headband, thereby reducing the "life" of the tennis net. Moreover, prior singles sticks commonly slip from under the net and frequently require repositioning during play. Tennis players also commonly misplace and lose the singles sticks. Because of these and other inconveniences, tennis players commonly play singles games with the tennis net set for doubles play, thus overlooking an official rule of tennis.

Thus, a need exists for a tennis net which is easily adapted for singles and doubles games and which does not interfere with the players' line of sight.

SUMMARY OF THE INVENTION

One aspect of the present invention involves a tennis net configured to define a vertical plane which generally extends from the ground to a specified height. The tennis net generally has a straight top edge and a convex bottom edge; however, the tennis net presents a substantially straight bottom edge generally juxtaposing the court when the net is installed with a conventional center strap pulling the top of the net towards the ground.

Besides the obvious aesthetic advantages associated with the present tennis net, tennis balls more often rebound to the player or at least away from the tennis net during play, rather than getting caught in the folds of the net. Thus, tennis players do not have to fish their tennis balls out of the folds of the tennis net. Moreover, the tennis net does not interfere with the players' line of sight because it presents a straight vertical plane extending up from the ground and allows a player to see the entire area of the opponent's side of the court.

In a preferred embodiment, the bottom edge of the tennis net has a chevron shape extending into the body of the netting. The bottom edge further defines an apex which is preferably generally positioned at a longitudinal center point of the tennis net to coincide with the position of the center strap when the net is installed. The tennis net is configured to be symmetric about the longitudinal center point.

Another aspect of the present invention involves a tennis net comprising caps for a pair of singles sticks used to convert the tennis net from a configuration suited for doubles play to a configuration suited for singles play. In a preferred embodiment, the tennis net comprises a pair of caps positioned generally outside of the sidelines of the singles court when the tennis net is installed. When setting up the tennis net for singles play, the singles sticks are inserted into the caps and engage the cable to prop the headband of the tennis net to a regulation net post height. The caps prevent the singles stick from twisting and fraying the headband, thus improving the playing condition of the court and preserving the tennis net.

The tennis net additionally includes a pair of storage pockets, each pocket being configured to receive a singles stick for storage when the singles stick is not in use. The singles sticks, therefore, are not easily lost or misplaced.

In accordance with a further aspect of the present invention, the tennis net comprises a pair of supports coupled to a netting portion of the tennis net. The supports are movable between a first position supporting the tennis net when used for singles play and a second position not supporting the net, when used for doubles play.

In a preferred embodiment each support is collapsible from the first position to the second position and comprises a singles stick and an elongated cap defining a socket. The singles stick preferably has a length of about 37.0 inches (0.9398 meter) and the cap has a length of about 6.0 inches (0.1524 meter) with a socket depth of about 1.0 inch (0.0254 meter), such that when the singles stick is inserted into the socket of the cap, the support has a length of about 42.0 inches (1.07 meter) when in the first position.

In accordance with a preferred method installing a tennis net on a tennis court, the tennis net is first positioned between a pair of net posts on the tennis court. An upper edge of the tennis net is then hung from a cable extended between the net posts and a center point of the upper edge is positioned below the top corners of the tennis net. The upper edge is straighten between each upper corner and the center point and the bottom edge is straightened such that the bottom edge does not significantly bunch on the tennis court.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF THE PREFERRED EMBODIMENTS

Figure 1:
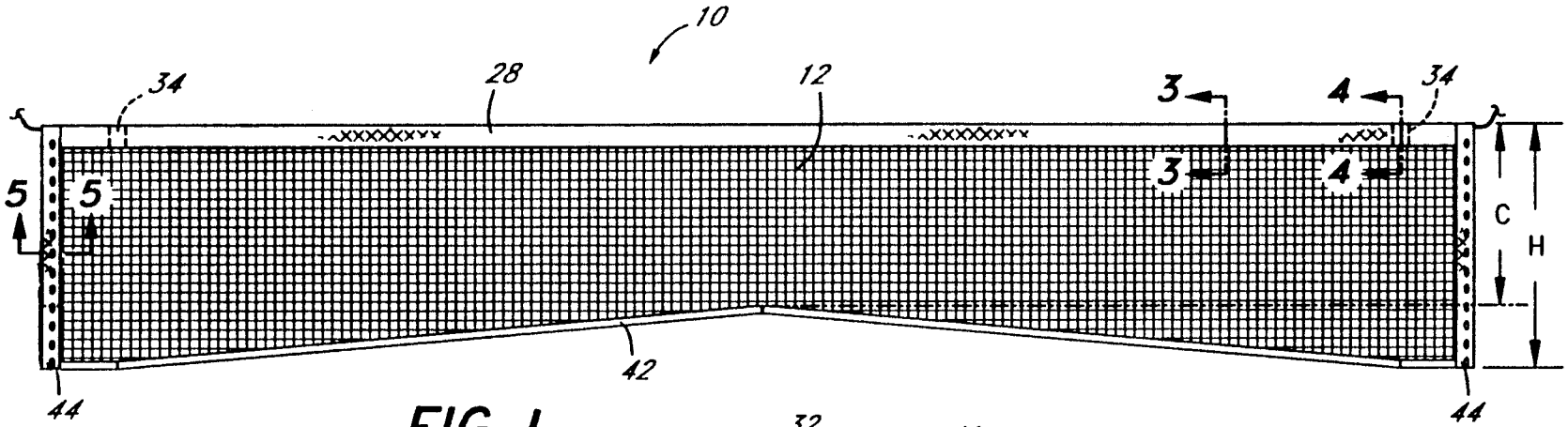
FIG. 1 is a front elevational view of a tennis net in accordance with one embodiment of the present invention.

FIG. 1 illustrates a tennis net 10 in accordance with a preferred embodiment of the present invention. The tennis net 10 is configured to present a straight, taut appearance defining a vertical plane when installed and is configured to be adaptable for both singles and doubles play. Both of these features will be discussed in detail below.

Figure 2:
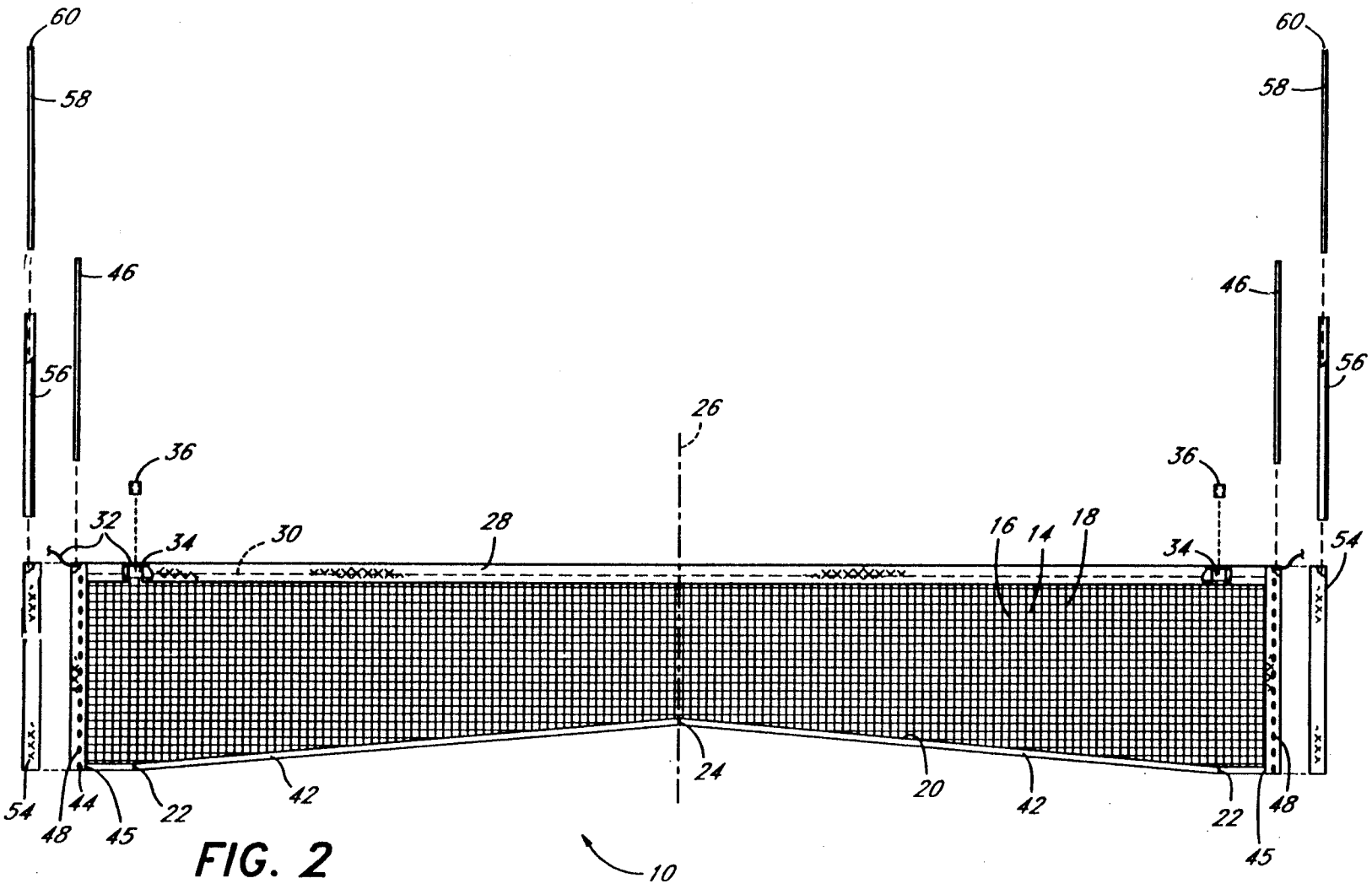
FIG. 2 is an exploded front elevational view of the tennis net of FIG. 1.

Referring to FIGS. 1 and 2, the tennis net 10 comprises a mesh sheet 12 formed by a plurality of longitudinal cords 14 extending generally parallel to the ground and a plurality of transverse cords 16 extending generally perpendicular to the ground. A plurality of knots 18 join the longitudinal cords 14 and transverse cords 16 at the intersections of the cords 14, 16.

The mesh 12 includes a concave bottom edge 20 which extends into the body of the mesh 12. The bottom edge 20 preferable has a chevron shape extending from a pair of transition points 22 into the body of the mesh 20 with an apex 24 of the chevron shape generally positioned at a longitudinal center 26 of the mesh 12.

As illustrated in FIG. 1, the mesh 12 in a preferred embodiment has a height H at its sides of approximately 42.0 inches (1.07 meters) and a height C at the apex 24 of the bottom edge 20 of approximately 36.0 inches (0.91 meter).

Figure 3:
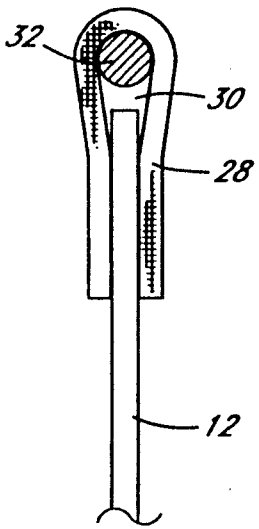
FIG. 3 is partial cross-sectional view of the tennis net of FIG. 1 taken along line 3—3.

Referring to FIGS. 2 and 3, a headband 28 edges the upper edge of the mesh 12. The headband 28 comprises a material sheet folded in half and sewed together at its ends with the upper edge of the mesh 12 positioned between the folded halves. The stitching preferably forms a longitudinal pocket 30 at a fold of the headband 28 extending along the length of the headband 28. The longitudinal pocket 30 is sized to receive a tension cable 32 which extends beyond the ends of the headband 28. In a preferred embodiment, the headband 28 comprises a vinyl sheet having a width of about 6.0 inches (0.152 meter) such that when sewed to the mesh 12 the headband 28 has a width equal to approximately 3.0 inches (0.076 meter).

Figure 4:
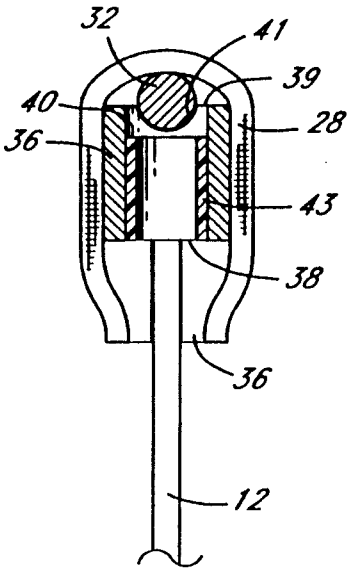
FIG. 4 is a partial cross-sectional view of the tennis net of FIG. 1 taken along line 4—4.

Referring to FIGS. 2 and 4, the headband 28 includes a pair of transverse pockets 34. Each transverse pocket 34 is formed between two parallel rows of stitching and the fold of the headband 28. Each transverse pocket 34 is positioned from the side of the tennis net 10 by approximately 4.5 feet (1.37 meters). As best seen in FIG. 4, the longitudinal stitching along the bottom edge of the headband 28 is severed to form an opening 36. Each transverse pocket 34 receives a plastic, tubular, sleeve-like cap 36 glued and sewed in place with an open end 38 positioned adjacent to the opening 36 of the transverse pocket 34.

Each cap 36 preferably has a length of about 2.0 inches (0.0508 meter) and defines an inner cavity 40 having a interior diameter generally equal to about ¼ inch (0.0064 meter). The cap 36 further defines a pair of semicircular notches 41 positioned diametrically opposite from each other at an end 39 of the cap 36 opposite of the open end 38. The notches 41 are sized to receive a portion of the cable 36 which passes through the headband 28 in a direction generally parallel to the longitudinal cords 14 of the mesh 12. As best seen in FIG. 4, each cap 36 also includes a thin, soft plastic inner tube 43 glued inside the inner cavity 40 of the tubular cap 36.

Referring back to FIG. 2, a bottom border 42 edges the bottom edge 20 of the mesh 12. The bottom border 42 comprises a material sheet folded in half and sewed together with the bottom edge of the mesh 12 positioned between the folded halves. For manufacturing ease, the bottom border preferably comprises two separate strips of material sheets, each of which extends for the bottom transition point 22 to the apex 24 of the mesh bottom edge 20. In a preferred embodiment, the bottom border 42 comprises vinyl sheets having widths of about 6.0 inches (0.152 meter) such that when sewed to the mesh 12, the bottom border 42 has a width equal to approximately 3.0 inches (0.076 meter).

Although FIG. 2 illustrates the transition points 22 of the bottom edge 20 positioned to coincide with the position of the headband transverse pockets 34, as measured towards the net center 26 from the sides of the net 10, it is understood that the transition points 22 could be positioned at any location proximate to the sides of the tennis net 10. For instance, if the tennis net 10 were designed specifically for a singles court or for a doubles court, the transition points 22 would preferably be positioned at the lower corners 45 of the mesh 12.

Figure 5:
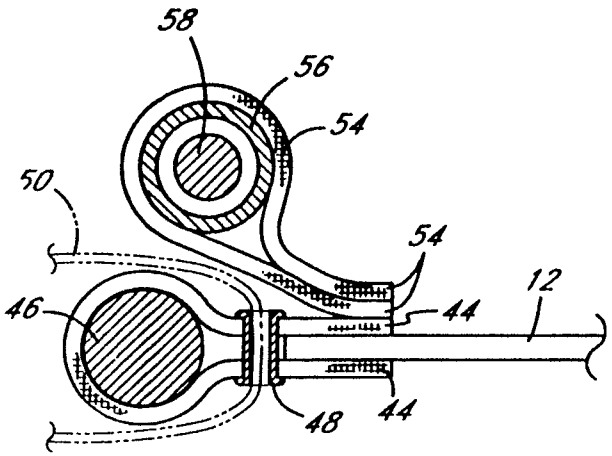
FIG. 5 is a partial cross-sectional view of the tennis net of FIG. 1 taken along line 5—5.
Figure 6:
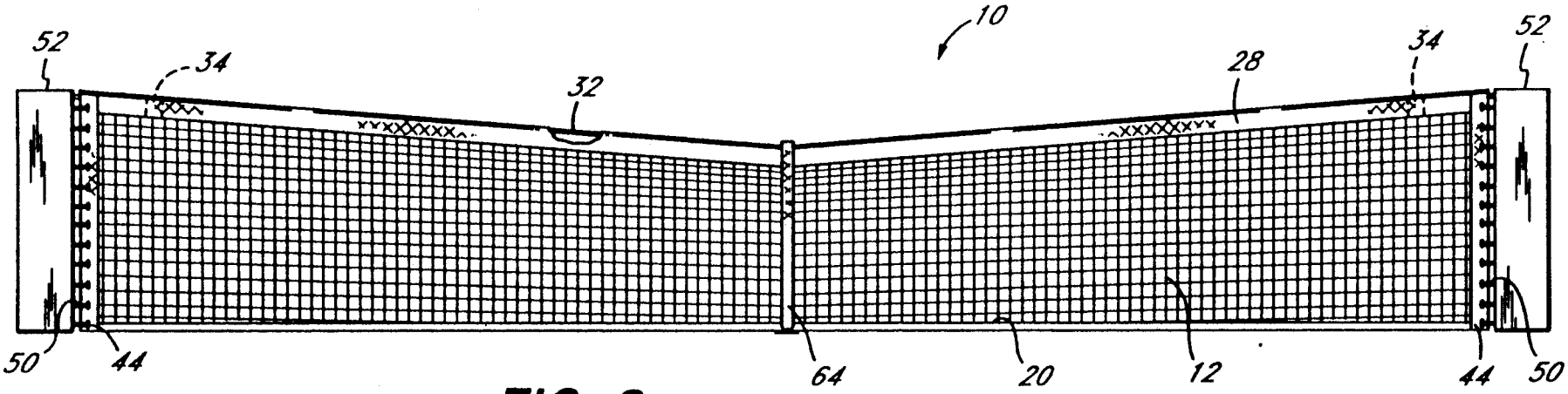
FIG. 6 is a front elevational view of the tennis net of FIG. 1 installed on a tennis court in accordance with the rules of tennis for doubles play.

A pair of transverse borders 44 edge the sides of the mesh 12. Each transverse border 44 comprises a material sheet folded in half and sewed together at its ends with a side edge of the mesh 12 positioned between the folded halves. As seen in FIGS. 2 and 5, a dowel 46, generally sized to the length of the transverse border 44, fits in the fold formed by the folded halves of the transverse border 44. The transverse border 44 further includes a plurality of grommets 48 positioned along the length of the transverse border 44. The grommets 48 define a series of apertures which receive a cord 50 used to secure and to juxtapose the side of the tennis net 10 against a net post 52 (FIG. 6). The top edge of the transverse border 44 is sewed closed, and the folded edge of the transverse border 44 is severed to permit the cable 32 to be threaded through the headband 28. In a preferred embodiment, each transverse border 44 comprises a vinyl sheet having a width of about 6.0 inches (0.152 meter) such that when sewed to the mesh, the transverse border has a width equal to approximately 3.0 inches (0.076 meter).

Referring back to FIGS. 2 and 5, the tennis net 10 additionally includes a pair of storage pockets 54 positioned generally parallel to the transverse borders 44. Each storage pocket 54 comprises a material sheet folded in half and sewed together at its edges to the transverse border 44. The stitching preferably forms a pocket between the fold of the material. Longitudinal stitching at the bottom of the storage pocket 54 closes the storage pocket 54 and the upper end of the storage pocket 54 forms an opening.

The storage pocket 54 is sized to receive a cylindrical casing 56 having a length equal to about the height H of the mesh 12. The cylindrical casing 56 preferably comprises a ½-inch (0.127 meter) outer diameter, plastic tubing having an interior diameter generally equal to about ¼ inch (0.0064 meter). When assembled together, as illustrated in FIG. 5, the cylindrical casing 56 fits within the storage pocket 54 and is preferably sewed in place, leaving exposed the upper openings of the transverse pocket 54 and the cylindrical casing 56.

Figure 9:
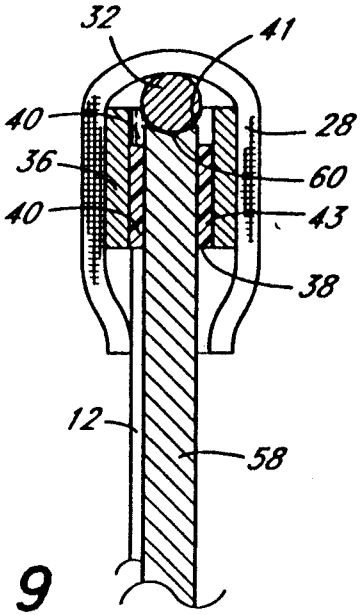
FIG. 9 is a partial cross-sectional view of the tennis net of FIG. 8 taken along line 9—9.

The tennis net 10 additionally includes a pair of singles sticks 58. Each singles stick 58 comprises a metal rod having a length generally equal to the height H of the tennis net 10 and defining a notch 60 at one end configured to engage the cable 32 (FIG. 9). Each singles stick 58 also has a diameter sized to fit within the cylindrical casing 56 and to fit within the headband cap 36, as will be discussed in detail below.

The tennis net 10 is constructed from a sheet of conventional tennis net mesh 12, which by the rules of tennis has a 42-inch (1.07-meter) height. The mesh 12 is cut to a length specified by the rules of tennis for doubles play, specifically to a length generally equal to about 42.0 feet (12.8 meters). For use on a tennis court dedicated for singles play, the net would have a length of 33.0 feet (10.1 meters).

Once the rectangular sheet of mesh is cut according to the rules of tennis for overall height and length, the bottom edge 20 of the mesh is cut to form the chevron shape. A manufacturer measures up 6.0 inches (0.1524 meter) in the transverse direction from the bottom edge 20 at the center 26 of the mesh 12 and marks the apex point 24. The manufacturer then stretches a chalked string from the marked point to the transition point 22 of the mesh 12 (generally 4.5 feet (1.37 meters) from the proximate lower corner 45 of the mesh 12) and "draws" a line between the transition point 22 and the marked point 24. That is, the manufacturer plucks the string to deposit a chalk line on the mesh 12. The manufacturer repeats this process between the marked apex point 24 and the other transition point 22. The manufacturer then cuts along the lines to form the chevron shape bottom edge 20.

The bottom border 42 and headband 28 then are sewed onto the mesh 12 by conventional processes. The headband 28 is stitched such that the longitudinal pocket 30 is formed at the fold of the headband material.

After sewing the bottom border 42 and headband 28 to the shaped mesh sheet 12, the transverse borders 44 and storage pockets 54 are sewed to the mesh 12. Specifically, the transverse borders 44 are folded in half and grommets 48 are installed adjacent to the fold of the material to form a pocket for the dowel 46. The dowel 46 is then placed in the pocket. The mesh 12 is subsequently inserted between the folded halves adjacent to the grommets 48 and sewed in place. The top and bottom edges of the transverse border 44 are preferably sewed closed and the stitching along the length of the transverse border 44 stops short of the upper edge of the transverse border to allow the cable 32 to pass through the transverse border 44 when assembled.

FIG. 6 illustrates a side elevational view of the tennis net 10 installed on a tennis court. The tennis net 10 stretches between two net posts 52 with the sides of the net 10 lashed to the net posts 52 by the cord 50. Specifically, the cord 50 is attached to the net post 52 and is threaded through the series of grommets 48 such that the cord 50 spirals around the net post 52 and dowel 46 to pull the dowel 46 and the transverse border 44 generally against the net post 52. The cable 32, attached at its ends to a conventional wrenching system (not shown), extends between the two net posts 52, passing through the headband 28 of the tennis net 10. A center strap 62 is wrapped around the headband 28 and the cable 32 and is attached to the ground to pull the center 26 of the net 10 down to a height specified by the rules of tennis. The cable 32 is pulled taut to stretch the net 10 between the dowels 46 and the cable 32.

As illustrated in FIG. 6, the tennis net 10 has a straight, taut appearance when installed. That is, the tennis net 10 substantially defines in a single vertical plane dividing the tennis court. When the center 26 of the tennis net 10 is pulled down to a specified height (e.g., 36 inches (0.91 meter)), the headband 28 is pulled into a V-shape and the bottom edge 20 is straightened. Thus, the bottom edge 20 of the net 10 stretches straight across the court between the net posts 52.

Figure 7:
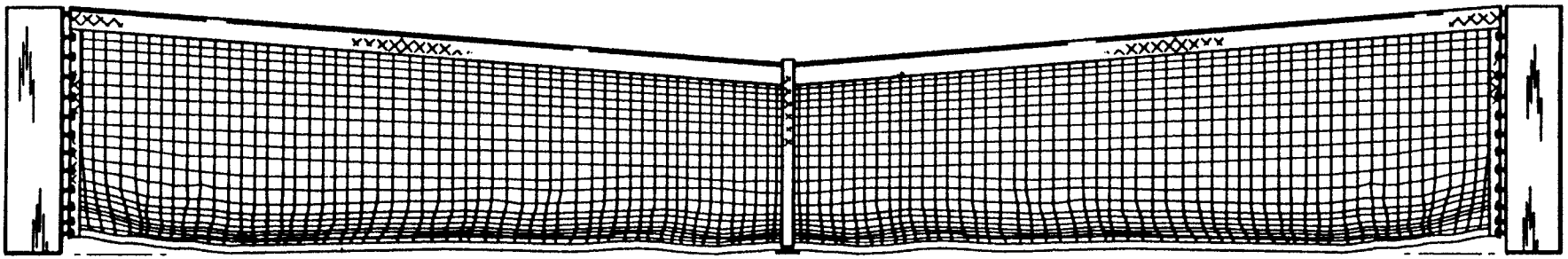
FIG. 7 (PRIOR ART)
FIG. 7 is a front elevational view of a prior tennis net installed on a tennis court in accordance with the rules of tennis for doubles play.

Contrast a conventional tennis net, as illustrated in FIG. 7, which is taut along its upper and side edges, but hangs loosely on the ground along its bottom edge. The bottom edge of the conventional tennis net bunches and falls out of the plane defined by the upper portion of the tennis net. Thus, the conventional tennis net does not substantially define a single vertical plane, as does the present tennis net 10.

Besides the obvious aesthetic advantages associated with the tennis net 10 of the present invention, tennis balls more often rebound to the player, or at least away from the tennis net during play, rather than getting caught up in the folds of the net which slows the game. In addition, tennis players do not have to fish their tennis balls out of the folds of the tennis net.

The present tennis net 10 is easily converted from doubles play to singles play. That is, the configuration of the tennis net 10 can be altered easily depending on whether two or four players are playing the game. FIG. 6 illustrates the tennis net installed on a tennis court and set up for doubles play. The singles sticks 58 are stored in the tubular casings 56 of the storage pockets 54 and the headband 28 of the tennis net 10 has a V-shape extending between the net posts 52.

Figure 8:
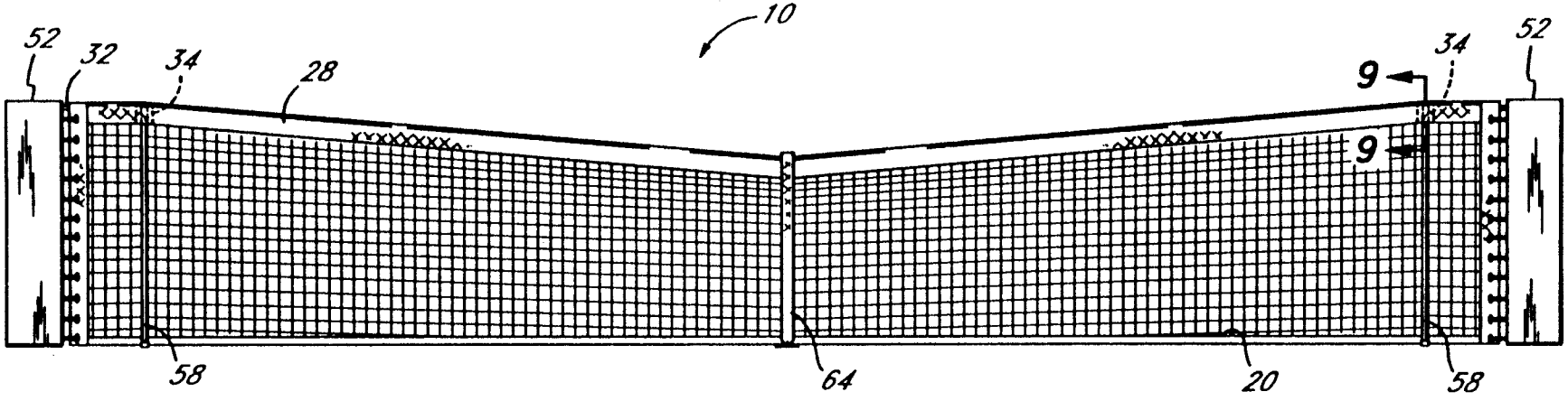
FIG. 8 is a front elevational view of the tennis net of FIG. 1 installed on a tennis court in accordance with the rules of tennis for singles play.

Alternatively, FIGS. 8 illustrates the tennis net 10 set up for singles play. The singles sticks 58 are removed from the storage pockets 54 and are inserted into the caps 36 in the headband 28. As best seen in FIG. 9, each singles stick 58 is inserted through the bottom opening 36 in the headband 28 and the into cap 36, pushing the mesh 12 to one side. When inserted through the inner tube 43 of the cap 36, the notch end 60 of the singles stick 58 engages the cable 32 extending between the notches 41 of the cap 36. The singles stick 58 slightly compresses the soft inner tube 43 to form a tight fit when inserted into the cap 36.

As shown in FIG. 8, the singles sticks 58 are positioned vertically to prop the headband 28 such that the headband 28 is parallel to the ground between each singles stick 58 and the adjacent support post 52; the headband 28 has a V-shape between the singles sticks 58. The tennis net 10 therefore has been configured to have the desired net post height specified by the rules of tennis 3.0 feet (0.91 meter) beyond the sidelines of the singles court. Thus, tennis players can easily adjust the tennis net 10 for singles play or for doubles play.

Figure 10:
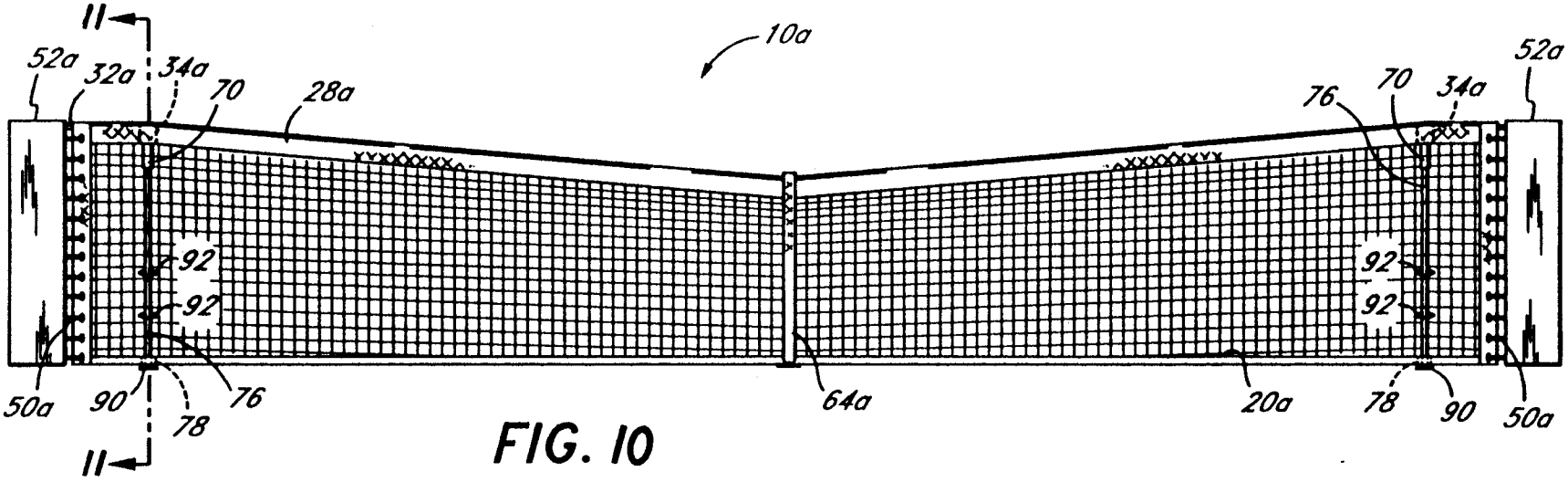
FIG. 10 is a front elevational view of a tennis net in accordance with another embodiment of the present invention installed on a tennis court in accordance with the rules of tennis for doubles play.

FIG. 10 illustrates another preferred embodiment of the invention installed on a tennis court and set up for singles play. Where appropriate, like numbers with an "a" suffix have been used to indicate like parts of the two embodiments for ease of understanding. The tennis net 10*a* comprises a mesh sheet 12*a* having a convex bottom edge 20*a*. A headband 28*a* edges the straight top edge of the tennis net 10*a*, and a pair of transverse borders 44*a* and a bottom border 42*a* edge the sides and bottom of the tennis net 10*a*, respectively. Each transverse border 44*a* includes a dowel 46*a* positioned between the fold of the transverse border 44*a* and a series of grommets 48*a* positioned along the length of the transverse border 44*a*.

The headband 28*a* includes a pair of transverse pockets 34*a*. Each transverse pocket 34*a* is formed between two parallel rows of stitching and the fold of the headband 28*a*. The longitudinal stitching along the bottom edge of the headband 28*a* is severed to form an opening 36*a*. Each transverse pocket 34*a* is positioned from the side of the tennis net 10*a* by approximately 4.5 feet (1.37 meters).

Figure 11:
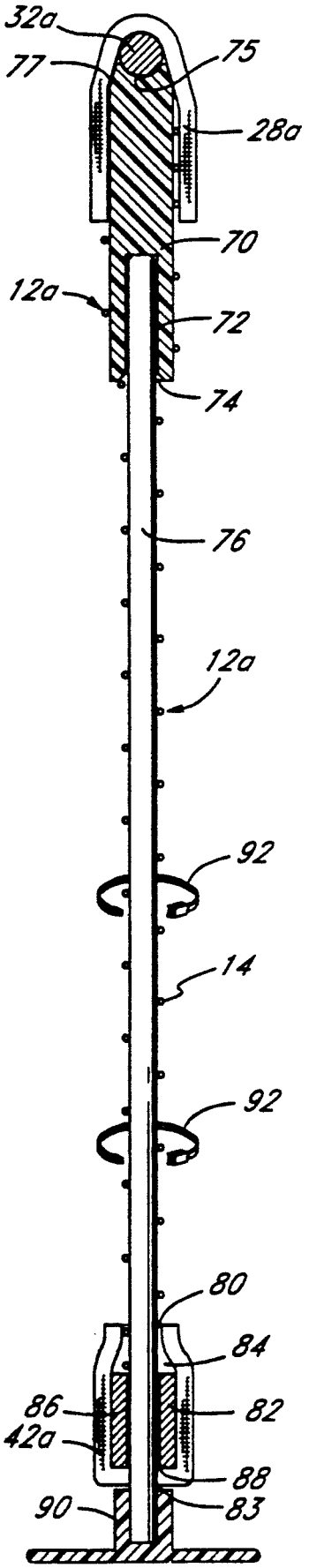
FIG. 11 is a cross-sectional view of the tennis net of the FIG. 10 taken along line 11—11.

As seen in FIGS. 10 and 11, each transverse pocket 34*a* receives an elongated cap 70 which is glued in place. The elongated cap 70 has a generally cylindrical body formed from a generally solid polyvinylchloride (PVC) rod and has a length of about 6.0 inches (0.153 meter). The elongated cap 70 defines a socket 72 extending into the body of the elongated cap from one end for a distance equal to about 2.0 inches (0.0508 meter), and more preferably for a distance equal to about 1-¼ inch (0.0317 meter). The socket 72 has an interior diameter generally equal to about a ¼-inch (0.0064 meter). An annular chamfer 74 circumscribes the opening of the socket 72 to ease the insertion of a singles stick 76, as discussed in detail below. The elongated cap 70 further defines a semi-circular groove 75 transversely positioned with respect to a longitudinal axis of the elongated cap 70. As seen in FIG. 11, the elongated cap 70 also includes a pair of chamfer edges 77 positioned diametrically opposite one another on opposite sides of the groove 75.

The tennis net 10*a* additionally comprises a pair of singles sticks 76. Each singles stick is a metal rod having a length generally equal to about 37.0 inches (0.94 meter) and having a diameter sized to fit within the elongated cap socket 72.

As best seen in FIGS. 10 and 11, the bottom border 42*a* includes a pair of transverse pockets 78, each pocket 78 being positioned from the side of the tennis net 10*a* by about 4.5 feet (1.37 meters). Each transverse pocket 78 is formed between two parallel rows of stitching and the fold of the bottom border 42*a*. The longitudinal stitching along the top edge of the bottom border 42*a* is severed to form an opening 80. Each transverse pocket 78 receives a plastic sleeve 82 glued and sewed in place with a first open end 84 positioned adjacent to the opening 80 of the transverse pocket 78.

Referring to FIG. 11, each sleeve 82 preferably has a length equal to about 1.0 inch (0.0254 meter) and defines an inner cavity 86 having an interior diameter sized to receive the singles stick 76. The fold of the bottom border 42*a* is severed adjacent to a second open end 88 of the sleeve 82 to create an opening 83.

As installed on the tennis court and set up for singles play, each singles stick 76*a* is woven through the longitudinal cords 14*a* of the mesh 12*a*, is inserted through the sleeve 82, and is extended through the opening 83 in bottom border 42*a*. The lower end of the singles stick 76 then is inserted into a base 90 which sits on the tennis court. A pair of clips 92 are used to secure the singles stick 76 to the mesh 12*a* of the tennis net 10*a*.

When the tennis net is set up for singles play, as shown in FIGS. 10 and 11, the upper end of the singles stick 76 is inserted into the interior cavity 72 of the elongated cap 70 to push the elongated cap 70 upwardly. Consequently, the singles stick 76 and the elongated cap 70 prop the cable 32 and the headband 28*a* such that the headband 28*a* is parallel to the ground between one of the singles sticks 76 and the adjacent net post 52*a*; the headband 28*a* has a V-shape between the singles sticks 76. Set up accordingly, the tennis net 10*a* has the desired net post height specified by the rules of tennis 3.0 feet (0.91 meter) beyond the sidelines of the singles court.

Figure 12:
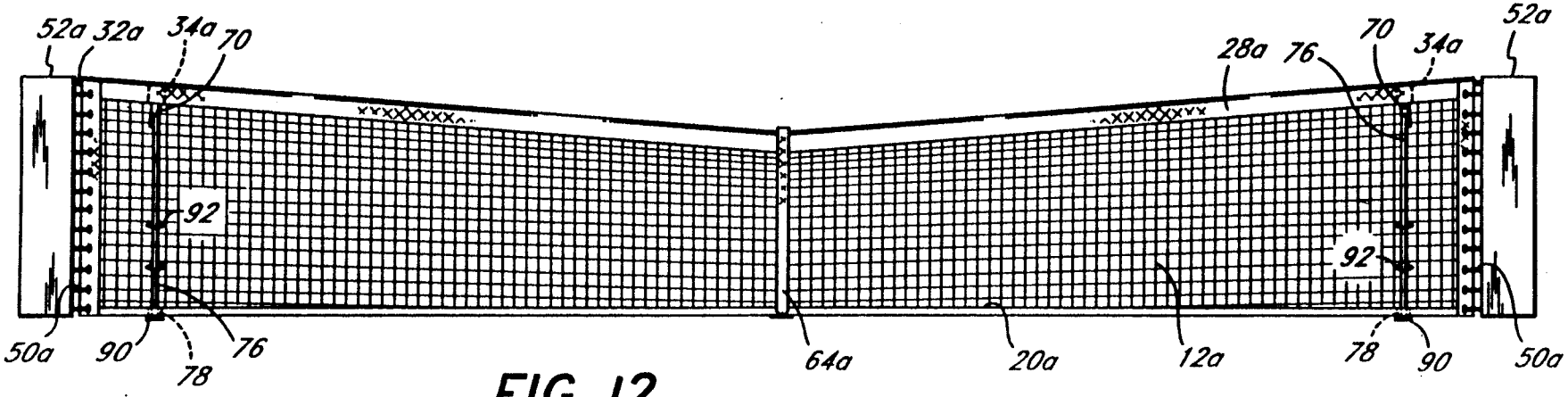
FIG. 12 is a front elevational view of the tennis net of FIG. 10 installed on a tennis court in accordance with the rules of tennis for singles play.

Alternatively, FIG. 12 illustrates the tennis net 10*a* set for doubles play. The top portion of the singles sticks 76 are removed from the interior cavities 72 of the elongated caps 70. Without the singles stick 76 propping the elongated caps 70, the center strap 64*a* pulls the headband 28*a* of the tennis net 10*a* into a V-shape between the net posts 52*a*. The corresponding singles stick 76*a* and the elongated cap 70 rest adjacent one another when disengaged. Importantly the upper end of singles sticks 76 are positioned at least 4.0 inches (0.1016 meters) below the top of the tennis net 10*a* when disengaged for the elongated caps 70 such that the singles sticks 76 do not present obstacles to the tennis players. That is, a tennis player will not contact the singles stick 76 when pushing down on the headband 28*a* because the cable 32*a* will typically not give more than a few inches in the vertical direction and certainly will not give more than 4.0 inches (0.1016 meters) in the vertical direction when properly installed.

Therefore, tennis players can easily adjust the tennis net height for singles and doubles play by placing the elongated cap 70 over the singles stick 76 to insert the singles stick 76 into the elongated cap socket 72. The collapsible support post formed by the elongated cap 70 and the singles stick 76 provide a convenient mechanism to alter the configuration of the tennis net 10*a*, depending upon whether two or four play players will be playing the game.

Although this invention has been described in terms of certain preferred embodiments, other embodiments that would be apparent to those of ordinary skill in the art are also within the scope of this invention. Accordingly, the scope of the invention is intended to be defined only by the claims which follow.

I claim:

1. A tennis net when installed on a tennis court and suspended between a pair of vertically extending, spaced apart support posts on a tennis court with a center strap pulling down the tennis net at a longitudinal center point to a center height C specified by the rules of tennis, said tennis net comprising:

a netting having a straight upper edge and a lower edge, said lower edge having a generally convex chevron shape with an apex being positioned to generally coincide with said longitudinal center point and being distanced from said upper edge by a distance generally equal to the center height C;

a headband connecting to said upper edge of the netting portion;

a cable extending through said headband and having each end thereof attached to a respective said support post;

a pair of caps connected to said headband and positioned to engage said cable, each cap defining a cavity and being positioned between a sideline of the singles court and the edge of the netting with the tennis net installed between the support posts; and a pair of single sticks, each singles stick having an end thereof fitting within said cavity of said cap.

2. The tennis net of claim 1, wherein said bottom edge is substantially symmetric about a longitudinal center point of said netting.

3. The tennis net of claim 1 additionally comprising a bottom border and a pair of transverse borders attached to and positioned around said netting.

4. The tennis net of claim 1, wherein said netting has a height equal to approximately 42.0 inches (1.07 meters) at the sides of the tennis net, and has a height equal to approximately 36.0 inches (0.914 meter) at said longitudinal center point of said netting.

5. A tennis net installed on a tennis court which defines a field of play for both singles and doubles play, the tennis court having a pair of vertically extending, spaced apart net posts positioned on longitudinal side lines of the court and a cable extended between the net posts to suspend said tennis net, said tennis net comprising:

a netting having a length substantially equal to a distance between the support posts; and a pair of caps, each cap being connected to said net between the sidelines of the singles court and a side edge of said netting when said tennis net is installed between the support posts, each cap engaging the cable and defining a cavity which receives a said singles stick.

6. The tennis net of claim 3, additionally comprising:

a pair of storage pockets attached to said netting at a position adjacent to the net posts with said tennis net installed on the tennis court; and a pair of single sticks having a length generally equal to said net height adjacent the net posts, said storage pockets being sized to receive said single sticks with said tennis net set for doubles play.

7. The tennis net of claim 6, additionally comprising a pair of tubular casings, each casing positioned in one of said storage pockets and configured to receive a said singles stick.

8. The tennis net of claim 5, additionally comprising a headband attached along the top edge of said netting, wherein said caps are positioned in said headband.

9. The tennis net of claim 3, wherein said netting has an upper edge and a lower edge, said lower edge having a chevron shape which extends into said netting.

10. The tennis net of claim 5, wherein said caps are positioned about 4.5 feet (1.37 meters) from said side edge of said netting.

11. A tennis net installed on a tennis court defining a field of play for both singles and doubles play, the tennis court having a pair of vertically extending, spaced apart net posts positioned on longitudinal side lines of the court and a cable extended between the posts and suspending said tennis net, said tennis net comprising:

a netting having a length substantially equal to a distance between the net posts, said netting comprising an upper edge and a lower edge spaced from said upper edge; and a pair of supports, each support being permanently attached to said tennis net and extending from said lower edge to said upper edge of said netting, each support having a first portion thereof manually movable from a first position supporting said tennis net for singles play in which said support holds said upper edge away from said lower edge, to a second position in which said support portion does not support said upper edge of said netting for doubles play, each of said supports having a second portion thereof extending to a point below said upper edge of said netting when positioned in said second position.

12. The tennis net of claim 11, wherein said first portion is a first elongated member and said second portion is a second elongated member, said first elongated member engaging said second elongated member to generally align said first and second members with said support being set in said first position, and said first elongated member disengaging from said second elongated member to collapse said support from said first position to said second position.

13. A tennis net for a tennis court defining a field of play for both singles and doubles play, the tennis court having a pair of vertically extending, spaced apart net posts, each post being positioned on opposite longitudinal sides of the court and a cable extended between the posts to suspend said tennis net across said court, said tennis net comprising:

a netting suspended between the net posts by said cable; and a pair of supports, each support being attached to said tennis net and having a portion thereby manually movable from a first position supporting said tennis net for singles play to a second position not supporting said tennis net for doubles play, each of said supports comprising an elongated cap defining a socket and a singles stick being sized to be removably inserted into said socket to position said support in said first position and to be removed from said socket to position said support in said second position.

14. The tennis net of claim 13, additionally comprising a headband, wherein said elongated cap is connected to said headband.

15. The tennis net of claim 13, wherein said elongated cap has a length of about 6.0 inches (0.1524 meter), said socket of said elongated cap has a length generally equal to about 1.0 inch (0.0254 meter) and said singles stick has a length generally equal to about 37.0 inches (0.9398 meter).

16. The tennis net of claim 13, wherein said singles stick is wove between a plurality of cords of said netting.

17. The claim 13, wherein each support engages the cable supporting the tennis net.

18. A method of setting a tennis net for singles play on a tennis court to define a field of play for both singles and doubles play, the tennis net having a pair of vertically extending, spaced apart net posts, each post being positioned on opposite longitudinal sides of the court and a cable extending between the net posts to support the tennis net, said method comprising the steps of:

providing a tennis net comprising a pair of supports, an upper edge and a lower edge, each support being permanently attached to said tennis net and extending from said lower edge to said upper edge, each support having a first portion manually movable from a first position in which said support supports said upper edge of said tennis net when used during singles play to a second position in which said support does not support said tennis net when used during doubles play; and moving said first portion of each support from said first position to said second position whereby a second portion of each support extends to a point below said upper edge of said tennis net.

19. A method of setting a tennis net for singles play on a tennis court to define a field of play for both singles and doubles play, the tennis net having a pair of vertically extending, spaced apart net posts, each post being positioned on opposite longitudinal sides of the court and a cable extending between the net posts to support the tennis net, said method comprising the steps of:

providing a tennis net comprising upper and lower edges; providing a pair of supports, each of said supports comprising a singles stick and a socket defining cap for receiving one end of said singles stick each support being attached to said tennis net and extending from said lower edge to said upper edge, said cap being manually movable from a first position in which said support supports said upper edge of said tennis net when used during singles play to a second position in which said support does not support said tennis net when used during doubles play; and moving each socket from said first position to said second position which comprises the steps of:

moving a cable supporting said tennis net away from said singles stick; and removing said singles stick from said socket of said cap.

* * * * *